United States Patent [19]

Werner et al.

[11] Patent Number: 5,054,157

[45] Date of Patent: Oct. 8, 1991

[54] COMBINATION STAND ALONE AND CANISTER VACUUM CLEANER

[75] Inventors: Kurt Werner, St. Joseph Township, Berrien County; Leo G. Krieger, Bainbridge Township, Berrien County, both of Mich.; Wilbur C. Bewley, Lexington, Ky.; Ennis L. Tillman, Danville, Ky.; Richard D. Riesberg, Danville, Ky.

[73] Assignee: Whirlpool Corporation, Benton Harbor, Mich.

[21] Appl. No.: 354,443

[22] Filed: May 19, 1989

[51] Int. Cl.[5] ..... A47L 5/36

[52] U.S. Cl. ..... 15/328; 15/377; 15/422.2

[58] Field of Search ..... 15/300 A, 331, 332, 15/333, 328, 377

[56] References Cited

U.S. PATENT DOCUMENTS

| | | | |
|---|---|---|---|
| 2,348,861 | 5/1944 | Smellie | 15/331 X |
| 3,039,130 | 6/1962 | Belicka et al. | 15/331 X |
| 3,184,775 | 5/1965 | Downey et al. | 15/377 X |
| 3,199,138 | 8/1965 | Nordeen | 15/350 |
| 3,226,758 | 1/1966 | Brown et al. | 15/377 X |
| 3,310,828 | 3/1967 | Clark et al. | 15/323 |
| 3,715,775 | 2/1973 | Nickelson | 15/410 |
| 4,050,112 | 9/1977 | Saxon | 15/300 A |
| 4,137,599 | 2/1979 | Steyer | 15/300 A |
| 4,419,784 | 12/1983 | Lex | 15/344 |
| 4,610,047 | 9/1986 | Dick et al. | 15/319 |
| 4,615,068 | 10/1986 | Martin et al. | 15/328 X |
| 4,686,736 | 8/1987 | Petralia et al. | 15/332 |

*Primary Examiner*—Chris K. Moore

*Attorney, Agent, or Firm*—Jeffers, Hoffman & Niewyk

[57] ABSTRACT

A vacuum cleaner is provided that is alternatively operable as a stand alone, upright vacuum cleaner and as a canister vacuum cleaner. The vacuum cleaner includes a nozzle assembly having a beater brush, a suction fan and a motor that drives both the beater brush and suction fan. A dirt tube assembly includes a first air flow passageway that directs dirt from the nozzle assembly to a dirt box and also includes a second air flow passageway that directs dirt from the nozzle assembly to a handle. The handle includes an air flow passageway that is coupled to the second air flow passageway in the dirt tube assembly. The handle is alternatively interconnectable with a cap for sealing the handle air flow passageway to operate the vacuum cleaner as a stand alone, upright vacuum cleaner wherein dirt is directed from the nozzle by the nozzle suction fan through the first air flow passageway to the dirt box. The handle is also interconnectable with a hose assembly coupled to a canister unit having a suction fan driven by a motor such that dirt is directed by canister suction fan from the nozzle assembly through the second air flow passageway to the hose assembly and a canister dirt receptacle to operate the vacuum cleaner as a canister vacuum cleaner. The vacuum cleaner may also be operated in a clean out mode to automatically clean out the dirt box. Further, when operated as a canister vacuum cleaner, the nozzle suction fan and canister suction fan operate together to provide improved cleaning action.

46 Claims, 3 Drawing Sheets

10
12
14
16
18
20
22
28
32
33
34
35
36
38
40
41
42
44
46
47
48
49
50
52
54
56
58
60
68
69

62
25
26
81
23
56
77
30
24
60
66
86
70
64
84
68
82
72
78
83
79
76
80

25
A
26
24
86
100
45
22
20
B
C
23
30
82
98
130
32
91
32
95
97
102
114
126
92
105
106
110
108
107
104
112
90
96
94
100
126
32
100
116
118
120
122
124
112

COMBINATION STAND ALONE AND CANISTER VACUUM CLEANER

BACKGROUND OF THE INVENTION

1. Field of the Invention

The present invention relates to a vacuum cleaner and more particularly to a vacuum cleaner that may be alternatively operated as a stand alone, upright vacuum cleaner and as a canister vacuum cleaner.

2. Description of the Prior Art

Canister vacuum cleaners are known, such as shown in U.S. Pat. Nos. 3,588,943 and 4,357,729, having a power nozzle with a beater brush driven by a motor coupled to the beater brush by a belt or the like. The power nozzle in such canister vacuum cleaners is typically coupled to a wand having an air flow passageway therethrough, the wand being coupled to a handle. The handle further includes an air flow passageway that is coupled to a hose having an air flow passageway leading to a dirt receptacle in a canister unit that includes a suction fan driven by a motor.

Stand alone, upright vacuum cleaners are also known as shown in U.S. Pat. No. 3,199,138 having a power nozzle with a beater brush driven by a motor coupled to the brush by a belt or the like wherein the motor also drives an impeller or suction fan for directing dirt from the power nozzle through a conduit to a dirt receptacle.

Canister vacuum cleaners and stand alone, upright vacuum cleaners have different advantages associated therewith. However, neither type of vacuum cleaner has been able to fully provide the advantages associated with the other type of vacuum cleaner to the user.

SUMMARY OF THE INVENTION

In accordance with the present invention, the disadvantages of prior art vacuum cleaners as discussed above have been overcome. The vacuum cleaner of the present invention may be operated as a canister vacuum cleaner or as a stand alone, upright vacuum cleaner to provide the advantages of both types of vacuum cleaners to the user.

More particularly, the vacuum cleaner of the present invention includes a nozzle assembly having a beater brush, a suction fan and a motor for driving the beater brush and suction fan. A receptacle is provided for collecting dirt when the vacuum cleaner is operated as a stand alone vacuum cleaner. A tube assembly includes a first air flow passageway that directs dirt from the nozzle to the receptacle for the stand alone vacuum cleaner and includes a second air flow passageway that directs dirt from the nozzle to a handle having an air flow passageway therein that is coupled to the second air flow passageway of the tube assembly. The handle of the vacuum cleaner is alternatively interconnectable with a cap that seals the handle air flow passageway and with a hose assembly that provides an air flow passageway coupled to a canister unit having a suction fan driven by a motor to collect dirt in a canister receptacle. When the handle is connected with the cap so that the handle air flow passageway is sealed, dirt is directed from the nozzle assembly by the nozzle suction fan through the first air flow passageway to the stand alone vacuum cleaner dirt receptacle to operate the vacuum cleaner as a stand alone vacuum cleaner. When the handle is connected with the hose assembly, dirt is directed by the canister suction fan from the nozzle assembly through the second air flow passageway of the tube assembly, to the hose assembly and canister receptacle to operate the vacuum cleaner as a canister vacuum cleaner. In addition to being connectable to a canister unit, the hose assembly may be connected to a central vacuum cleaner system for directing dirt to a stationary dirt repository.

The nozzle motor is further coupled to power lines that extend from the nozzle motor to the handle wherein the cap includes a power cord that is connectable with the nozzle motor power lines to couple power from an external source to the nozzle motor. The hose assembly also includes power lines that are connectable with the nozzle motor power lines when the hose assembly is connected to the handle for coupling power from an external power source to the nozzle motor when the vacuum cleaner is operated as a canister vacuum cleaner. Alternately, the nozzle motor may be battery operated.

Further, the vacuum cleaner of the present invention is operable in a clean out mode wherein the nozzle assembly is sealed off from the tube assembly to prevent air flow there-between. In the clean out mode, the hose assembly is connected to the vacuum cleaner handle and the canister suction fan is driven to create a negative pressure within the stand alone vacuum cleaner dirt receptacle to open a pair of air inlet valves on the stand alone vacuum cleaner dirt receptacle. When the air inlet valves are opened, air external to the vacuum cleaner enters the dirt receptacle through the valves with the dirt contained in the receptacle being drawn through the second passageway of the dirt tube assembly and through the air passageways formed in the handle and hose assembly to the canister dirt receptacle to automatically clean out the stand alone vacuum cleaner dirt receptacle.

Further, in the canister vacuum cleaner mode of operation, the nozzle suction fan is operated in conjunction with the canister suction fan. The combination of a nozzle suction fan and a canister suction fan for a canister vacuum cleaner facilitates the cleaning action thereof.

These and other objects, advantages and novel features of the present invention, as well as details of an illustrated embodiment thereof, will be more fully understood from the following description and the drawing.

DESCRIPTION OF THE PREFERRED EMBODIMENT

Figures 1, 2, 3:
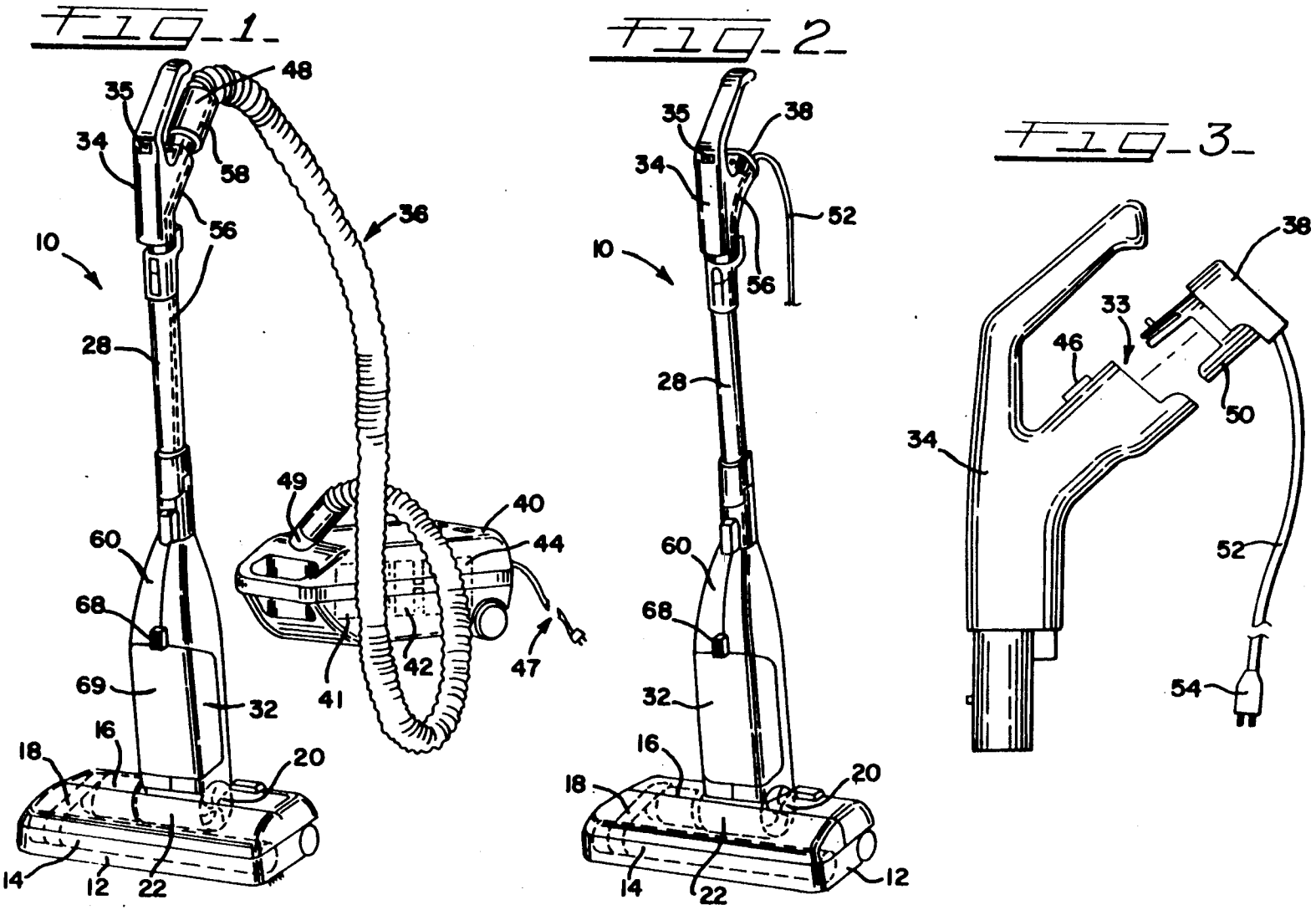
FIG. 1 is a perspective view of a vacuum cleaner constructed in accordance with the principles of the present invention and operated as a canister vacuum cleaner.
FIG. 2 is a perspective view of the vacuum cleaner shown in FIG. 1 operated as a stand alone vacuum cleaner.
FIG. 3 is an enlarged side view of the vacuum cleaner handle shown in FIG. 2.
Figures 5, 6, 7:
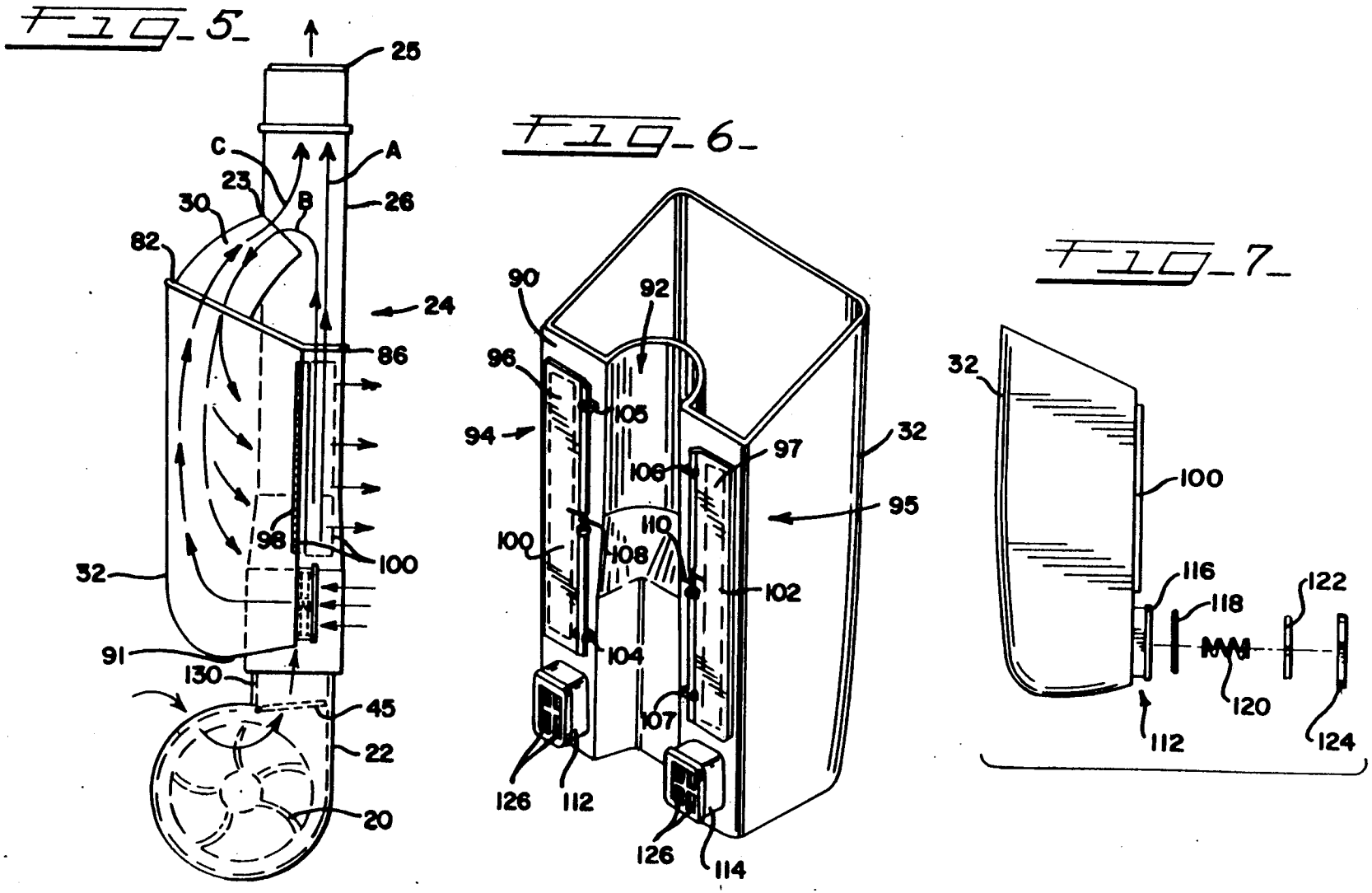
FIG. 5 is a side view of the dirt tube, dirt box and swivel of the vacuum cleaner shown in FIGS. 1 and 2, illustrating air flow paths in various modes of operation.
FIG. 6 is a perspective view of the dirt box shown in FIGS. 1 and 2 as seen from the rear.
FIG. 7 is a side view of the dirt box shown in FIG. 6 with an exploded view of an air inlet valve.

A vacuum cleaner 10 constructed in accordance with the present invention is operable as a canister vacuum cleaner as shown in FIG. 1 or as a stand alone, upright vacuum cleaner as shown in FIG. 2. The vacuum cleaner 10 includes a power nozzle assembly 12 having a beater brush 14 driven by a motor 16 that is coupled to the beater brush 14 by a belt 18. The motor 16 also drives a suction fan or impeller 20 disposed in a swivel 22 that is pivotable with respect to the power nozzle 12. The swivel 22, as shown in FIG. 5, has an air inlet 23 through which dirt picked up by the power nozzle enters. The swivel 22 is coupled to a rigid dirt tube assembly 24 having an air flow passageway 26 leading from the swivel 22 to a wand assembly 28. The dirt tube assembly 24 has another air flow passageway 30 coupled between the air flow passageway 26 and a dirt box 32 that forms a receptacle for collecting dirt when the vacuum cleaner 10 is operated as a stand alone vacuum cleaner. The wand assembly 28 forms an air flow passageway coupled between the air flow passageway 26 of the dirt tube assembly 24 and an air flow passageway formed in a handle 34. The handle 34 is alternatively interconnectable with a hose assembly 36 to provide a canister vacuum cleaner as shown in FIG. 1 and with a cap 38 to provide a stand alone, upright vacuum cleaner as shown in FIG. 2.

When the vacuum cleaner 10 is operated as a canister vacuum cleaner, the hose assembly 36 is connected to the handle 34 by inserting a mating portion 48 into an outlet port 33 of the handle 34 so as to connect the air flow passageway of the handle 34 with an air flow passageway formed by the hose assembly 36. The hose assembly 36 is coupled to a dirt receptacle 41 in a canister unit 40 wherein the canister unit 40 includes a motor 44 for driving a suction fan 42 that draws dirt from the power nozzle 12 through the dirt tube assembly 24, wand 28, handle 34 and hose assembly 36 to collect dirt in the canister unit when the vacuum cleaner 10 is operated as a canister vacuum cleaner. The suction fan 42 may also be operated to clean out the dirt box 32 in a clean out mode of operation when the swivel 22 is placed in an upright position, moving a flapper valve 45 to its closed position as shown in FIG. 5. When the hose assembly 36 is coupled to the handle 34, power lines 56 (a portion of which are shown in phantom in the wand 28 and handle 34) extending from the nozzle motor 16 through the handle 34 are electrically connected to power lines 58 (a portion of which is shown in phantom in the mating portion 48) extending from the mating portion 48 through the hose assembly 36 and inlet port 49 to a conventional power cord 47 that extends from the canister unit 40 for electrical connection with an external power source to provide power to the nozzle motor 16 and canister motor 44.

To change the vacuum cleaner 10 from a canister vacuum cleaner as shown in FIG. 1 to a stand alone vacuum cleaner as shown in FIG. 2, a quick release button 46 is actuated to disengage the mating portion 48 of the hose assembly 36 from the handle 34. Thereafter, the cap 38 is connected to the handle 34 by inserting a connecting portion 50 of the cap 38 into the outlet port 33 of the handle 34 to seal the handle air flow passageway. Because the cap seals the handle air flow passageway, dirt picked up by the power nozzle is directed to the air flow passageway 30 of the dirt tube assembly 24 and into the dirt box 32, enabling the vacuum cleaner to operate as a stand alone vacuum cleaner. The cap 38 includes a power cord 52 having a plug 54 for connection with a standard external power source to provide power to the motor 16 through the power cord 52 and the power lines 56 which are electrically connected when the connecting portion 50 of the cap is inserted into the handle aperture 33.

Figure 4:
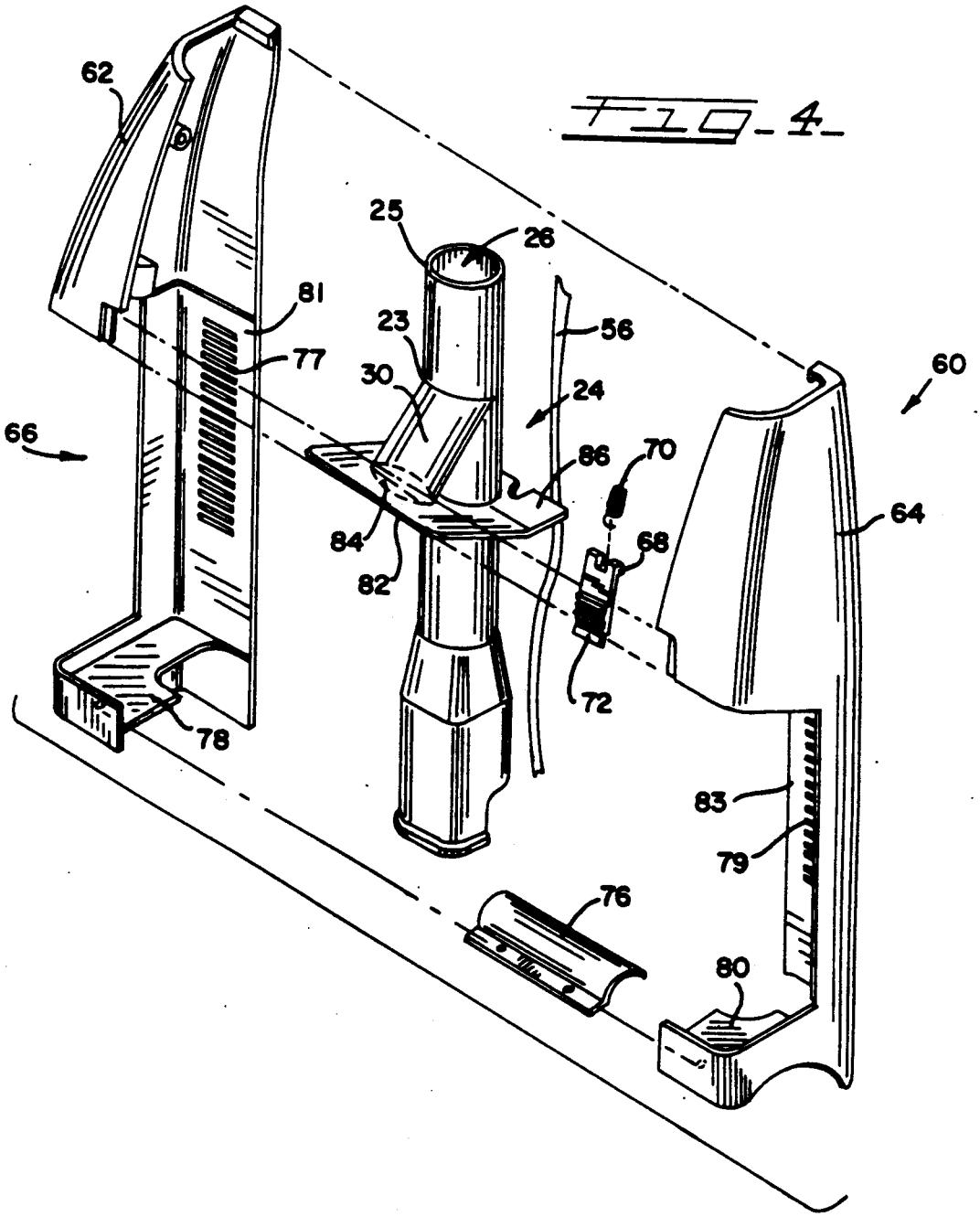
FIG. 4 is an exploded view of the dirt box/dirt tube housing assembly for the vacuum cleaner shown in FIGS. 1 and 2.

As shown in FIG. 4, the dirt tube assembly 24 is contained in a housing 60 formed of housing members 62 and 64 that cooperate together to support the dirt box 32. More particularly, when the housing members 62 and 64 are secured together, an aperture 66 is formed in the housing for receiving the dirt box 32. The dirt box 32 is removably retained in the housing 60 by a sliding latch 68 coupled to the housing 60 by a latch spring 70 that biases the latch 68 downward so that a flange 72 on the latch 68 engages the front 69 of the dirt box 32. The dirt box 32 is easily removed from the vacuum cleaner 10 by sliding the latch 68 upward so that the flange 72 no longer engages the dirt box 32. When inserted into the housing aperture 66, the bottom of the dirt box 32 rests on a seat spring 76 secured to base plate members 78 and 80 of respective housing members 62 and 64. The seat spring 76 acts in conjunction with the latch 68 and spring 70 to retain the dirt box 32 firmly seated in the housing aperture 66. The housing members 62 and 64 further include vents 77 and 79 formed in respective back walls 81 and 83 thereof so as to allow air exhausted from the dirt box 32 to pass through the housing 60 for stand alone vacuum cleaner operation and to allow air from outside of the housing 60 to enter the dirt box as required for the dirt box clean out operation as described in detail below.

Dirt-laden air is directed through an inlet port 23 into an air passageway 30 which communicates between the air passageway 26 and the dirt box 32. The top of the dirt box 32 is open forming an aperture through which dirt may flow. To seal the top of the dirt box 32, the dirt tube assembly 24 includes a cover member 82 having an aperture 84 therein for cooperating with the air passageway 30 wherein the cover 82 engages the top of the dirt box 32. The cover member 82 is angled slightly with respect to the air passageway 26 so as to accommodate the angled top periphery of the dirt box 32. A flange 86, extending from the cover 82 rearwardly and generally perpendicular to the air passageway 26, is provided with an indentation therein to accommodate the power lines 56.

As shown in FIG. 6, the dirt box 32 includes a rigid body formed of injected molded plastic. The rear sidewall 90 of the dirt box is formed with an indentation 92 therein shaped to accommodate the dirt tube assembly 24 about which portions 94 and 95 of the dirt box 32 extend. The sidewall 90 further includes a pair of elongated apertures 96 and 97, shown in phantom, formed on opposite sides of the indentation 92 in the portions 94 and 95 to provide an exhaust for air when the vacuum cleaner 10 is operated as a stand alone vacuum cleaner as described in detail below. Disposed within each of the apertures 96 and 97 is a screen 98 or the like for filtering air passing through the apertures 96, 97. Flapper doors 100 and 102 are secured to the dirt box 32 by respective members 104, 105 and 106, 107 which allow the flapper doors 100 and 102 to be pivoted about respective axes extending through the members 104, 105 and 106, 107 so that the flapper doors 100 and 102 may be moved between closed positions as shown in FIG. 6 and an open position shown in phantom for the flapper door 100 in FIG. 5. Respective torsion springs 108 and 110 are provided to apply a force to the flapper doors 100 and 102 to maintain the doors closed as discussed below.

The rear sidewall 90 of the dirt box is further provided with a pair of air inlet valves 112 and 114 respectively disposed in the dirt box portions 94 and 95. Each of the air inlet valves 112 and 114 includes a valve body 116 having an aperture therein that cooperates with a respective aperture formed in the walls of the dirt box portions 94 and 95. A screen 118 is disposed within the aperture of the valve body 116 for filtering air. A compression spring 120 is positioned between the screen 118 and a plunger 122 having a diameter that is less than the diameter of the valve body aperture. A retaining cap 124 having apertures 126 therein is secured to the valve body 116 so as to retain the plunger 122 against the compression spring 120 in a normally closed position within the aperture formed in the valve body 116. A negative pressure within the dirt box 32 overcomes the force exerted by the compression spring 120 to pull the plunger 122 away from the retainer cap 124 to allow air to flow through apertures 126, around the plunger 122 and through the screen 118 to the interior of the dirt box 32 in order to clean out the dirt box 32 as described below.

To operate the vacuum cleaner 10 as a canister vacuum cleaner, the mating portion 48 of the hose assembly 36 is inserted into the handle outlet port 33 to connect the handle air flow passageway with the air flow passageway extending through the hose assembly 36 and to further electrically connect the power lines 56 for the nozzle motor 16 with the power lines 48 extending through the hose assembly 36. An ON/OFF switch 35 is then moved to the ON position to couple power from an external source through the canister power cord to the canister motor 44 and the nozzle motor 16. As shown in FIG. 1, the nozzle and canister suction fans 20 and 42 driven by respective motors 16 and 44 direct dirt from the beater brush 14, through the suction fan 20, and along a path A through the outlet port 25 of the dirt tube 24 and through the air flow passageways of the wand 28, handle 34 and hose assembly 36 to the receptacle in the canister unit 40 for collecting dirt. When the vacuum cleaner 10 is operated as a canister vacuum cleaner, the flapper doors 100 and 102 are maintained closed by the torsion springs 108 and 110. Because the nozzle suction fan 20 operates in conjunction with the canister suction fan 42 when the vacuum cleaner 10 is operated as a canister vacuum cleaner, improved dirt pick up is facilitated.

To operate the vacuum cleaner 10 as a stand alone, upright vacuum cleaner, the connecting portion 50 of the cap 38 is inserted into the handle aperture to seal off the handle air flow passageway and to connect the power lines 56 of the nozzle motor 16 with the power cord 52. When the power cord 52 is connected to an external power source through the plug 54 and the ON/OFF switch 35 is moved to the ON position, the nozzle motor 16 rotates the beater brush 14 and the suction fan 20 to direct dirt from the beater brush 14, through the suction fan 20, and along a path B through the air flow passageways 26 and 30 of the dirt tube assembly 24 to the dirt box 32 for collecting the dirt. When the vacuum cleaner 10 is operated as a stand alone vacuum cleaner, the positive pressure within the dirt box 32, created by the suction fan 20 and the sealed off handle air flow passageway, overcomes the force applied by the torsion springs 108 and 110 to open the flapper doors 100 and 102 so that air may be exhausted through the filter 98 disposed in the apertures 96 and 97 of the dirt box 32.

In order to clean out the dirt box 32, the hose assembly 36 is coupled to the handle 34 of the vacuum cleaner 10 and the swivel 22 is moved to an upright position. When the swivel 22 is placed in an upright position, a projection in the nozzle 12 engages a detent on the flapper valve 45 to cause the flapper valve 45 to rotate from a vertical position adjacent a portion 130 of a vertical front wall of the swivel 22. The flapper valve rotates in a clockwise manner to its closed position shown in FIG. 5 to block off air flow from the swivel 22 to the dirt tube assembly 24. When the canister suction fan 42 is operated with the flapper valve 45 blocking air flow from the swivel 22 to the dirt tube assembly 24, the negative pressure within the dirt box 32 created by the canister suction fan 42 pulls the plungers 122 away from the retainer caps 124 of the air inlet valves 112 and 114. Air is thus drawn along a path C through the apertures 126 of the retainer caps 124, around the plungers 122 and through the screens 118 into the dirt box 32 where the air and the dirt contained within the dirt box 32 are drawn up through the air passageway 26 of the dirt tube assembly 24 and through the air flow passageways of the wand 28, handle 34 and hose assembly 36 to the dirt receptacle in the canister unit 40. This feature allows the dirt box 32 to be automatically cleaned out so that the dirt need only be manually removed from the canister receptacle.

Because the vacuum cleaner of the present invention may be operated as a stand alone vacuum cleaner and as a canister vacuum cleaner, the advantages of both types of vacuum cleaners are realized with one unit. One advantage of such a combination is that the dirt box 32 used for stand alone vacuum cleaner operation may be automatically cleaned out using the canister suction fan. Further, the vacuum cleaner when operated as a canister vacuum cleaner provides increased cleaning action due to the combination of the nozzle suction fan and the canister suction fan which operate together.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A vacuum cleaner system operable alternatively as a stand alone vacuum cleaner or as a canister vacuum cleaner comprising:

a nozzle assembly for directing dirt into said vacuum cleaner system;

first receptable means for collecting dirt when said vacuum cleaner system is operated as a stand alone vacuum cleaner;

second receptacle means for collecting dirt when said vacuum cleaner system is operated as a canister vacuum cleaner; and alternate directing means for alternatively directing dirt from said nozzle assembly to said first receptacle means when said vacuum cleaner system is operated as a stand alone vacuum cleaner or to said second receptacle means when said vacuum cleaner system is operated as a canister vacuum cleaner, said alternate directing means including an outlet port, and a tube assembly, said tube assembly extending from said nozzle assembly to said outlet port, said tube assembly defining a first air flow passageway extending to said outlet port for directing dirt to said second receptacle means through said outlet port and a second air flow passageway for directing dirt away from said outlet port to said first receptacle means.

2. A vacuum cleaner system as recited in claim 1 wherein said nozzle assembly includes a motor and a suction fan driven by said motor.

3. A vacuum cleaner system as recited in claim 1 wherein said nozzle assembly includes a motor and a beater brush driven by said motor.

4. A vacuum cleaner system as recited in claim 1 wherein said nozzle assembly includes a motor, a suction fan and a beater brush driven by said motor.

5. A vacuum cleaner system for cleaning floor surfaces comprising:

a stand alone vacuum cleaner including
a floor-contacting nozzle assembly having a swivel,
dirt receptacle means for collecting dirt,
an outlet port and
alternate directing means for alternatively directing dirt from said nozzle assembly to said dirt receptacle means or from said nozzle assembly to said outlet port, said alternate directing means including a tube assembly which is coupled directly to said swivel;

an external container including
an inlet port disposed on said external container,
a motor,
a fan driven by said motor for generating suction within said container and
a dirt-collecting receptacle for receiving dirt through said inlet port; and means for pneumatically interconnecting said outlet port on said stand alone vacuum cleaner to said inlet port on said external container to direct dirt from said outlet port to said inlet port.

6. A vacuum cleaner system as recited in claim 5 wherein said floor-contacting nozzle assembly includes a motor and a suction fan driven by said motor.

7. A vacuum cleaner system as recited in claim 5 wherein said floor-contacting nozzle assembly includes a motor, and a beater brush driven by said motor.

8. A vacuum cleaner system as recited in claim 5 wherein said floor-contacting nozzle assembly includes a motor, a suction fan driven by said motor, and a beater brush driven by said motor.

9. A vacuum cleaner system as recited in claim 5 wherein said external container is a canister unit.

10. A vacuum cleaner system for cleaning floor surfaces comprising:

a stand alone vacuum cleaner including
a floor-contacting nozzle assembly,
dirt receptacle means for collecting dirt,
an outlet port and
air flow passageway means for alternatively directing dirt from said nozzle assembly to said dirt receptacle means or from said nozzle assembly to said outlet port, said air flow passageway means including a tube assembly for receiving dirt from said nozzle assembly;

a first outlet in said tube assembly for directing dirt to said dirt receptacle means an external container including
an inlet port disposed on said external container,
a motor,
a fan driven by said motor for generating suction within said container and
a dirt-collecting receptacle for receiving dirt through said inlet port;

means for pneumatically interconnecting said outlet port on said stand alone vacuum cleaner to said inlet port on said external container to direct dirt from said outlet port to said inlet port; and a second outlet in said tube assembly for directing dirt outwardly from said outlet port to said pneumatically interconnecting means.

11. A vacuum cleaner as recited in claim 10 wherein said stand alone vacuum cleaner includes means for closing off said nozzle assembly from said tube assembly.

12. A vacuum cleaner as recited in claim 11 wherein said means for closing off said nozzle assembly from said tube assembly is a flapper vavle.

13. A vacuum cleaner as recited in claim 12 wherein said tube assembly is movable to a plurality of positions including an upright position relative to said nozzle assembly and said flapper valve operates inside said tube assembly adjacent said nozzle assembly to block off said air flow passageway when said tube assembly is placed in said upright position.

14. A vacuum cleaner as recited in claim 11 wherein said dirt receptacle means includes means for directing dirt outwardly from said dirt receptacle means to said second outlet when said nozzle assembly is closed off from said tube assembly.

15. A vacuum cleaner as recited in claim 11 wherein said dirt receptacle means includes means for automatically directing dirt outwardly from said dirt receptacle to said second outlet when said nozzle assembly is closed off from said tube assembly and when said means for pneumatically interconnecting said outlet port to said inlet port is interconnecting said outlet port to said inlet port.

16. A vacuum cleaner as recited in claim 10 wherein said tube assembly includes rigid sidewalls.

17. A vacuum cleaner as recited in claim 16 wherein a portion of said tube assembly forms a handle for said stand alone vacuum cleaner.

18. A vacuum cleaner as recited in claim 17 wherein said second outlet of said tube assembly forms a portion of said handle for said stand alone vacuum cleaner.

19. A vacuum cleaner as recited in claim 10 wherein said stand alone vacuum cleaner includes means for sealing off said second outlet of said tube assembly.

20. A vacuum cleaner as recited in claim 19 wherein said means for sealing off said second outlet of said tube assembly further seals off said outlet port of said stand alone vacuum cleaner.

21. A vacuum cleaner as recited in claim 20 wherein said means for sealing off said outlet port of said stand alone vacuum cleaner includes a cap.

22. A vacuum cleaner as recited in claim 21 wherein said cap includes power lines for supplying power to said stand alone vacuum cleaner.

23. A vacuum cleaner as recited in claim 10 wherein said means for pneumatically interconnecting said stand alone vacuum cleaner to said inlet port on said external container is a hose.

24. A vacuum cleaner as recited in claim 23 wherein said hose includes power lines for providing power to said stand alone vacuum cleaner.

25. A vacuum cleaner operable alternatively as a stand alone vacuum cleaner and as a canister vacuum cleaner with a hose assembly coupled to a canister having a suction fan driven by a motor to collect dirt in a receptacle, comprising:

a nozzle assembly for directing dirt into said vacuum cleaner;

receptacle means for collecting dirt when said vacuum cleaner is operated as a stand alone vacuum cleaner;

a tube assembly having a first air flow passageway for directing dirt from said nozzle assembly to said receptacle means and having a second air flow passageway for directing dirt from said nozzle along a second path; and a handle having an air flow passageway coupled to said second air flow passageway, said handle being alternatively interconnectable with a means for sealing said handle air flow passageway such that dirt is directed from said nozzle assembly through said first air flow passageway to said receptacle means to operate said vacuum cleaner as a stand alone vacuum cleaner and with said hose assembly such that dirt is directed by said cannister suction fan from said nozzle assembly through said second air flow passageway and said handle air flow passageway to said hose assembly and canister receptacle to operate said vacuum cleaner as a canister vacuum cleaner.

26. A vacuum cleaner as recited in claim 25 wherein said nozzle assembly includes a suction fan and a motor for driving said suction fan, said nozzle motor being coupled to power lines extending to said handle wherein said sealing means includes a power cord connectable with said power lines for coupling power to said nozzle motor.

27. A vacuum cleaner as recited in claim 25 wherein said nozzle assembly includes a beater brush and a motor for driving said beater brush, said nozzle motor being coupled to power lines extending to said handle wherein said hose assembly includes a second set of power lines connectable with said nozzle motor power lines for applying power to said nozzle motor.

28. A vacuum cleaner as recited in claim 25 wherein said receptacle means includes means for exhausting air therethrough when said vacuum cleaner is operated as a stand alone vacuum cleaner and means for closing said exhaust means to prevent air from passing therethrough when said vacuum cleaner is operated as a canister vacuum cleaner.

29. A vacuum cleaner as recited in claim 28 wherein said receptacle means includes rigid sidewalls.

30. A vacuum cleaner as recited in claim 29 wherein said exhaust means includes a filter disposed in an aperture formed in a sidewall of said receptacle means.

31. A vacuum cleaner as recited in claim 30 wherein said closing means includes a door and means for biasing said door is closed.

32. A vacuum cleaner as recited in claim 25 including means operable in a clean out mode for sealing off said nozzle assembly to prevent air flow therefrom to said receptacle means, said receptacle means including an air inlet means having an open state for allowing air external to said vacuum cleaner to enter said receptacle means such that said canister suction fan is operable to direct dirt collected in said receptacle means through said hose assembly to said canister receptacle when said nozzle sealing mean is operable in said clean out mode.

33. A vacuum cleaner as recited in claim 32 wherein the state of said air inlet means is changed from a closed state to said open state by pressure from said canister suction fan when said nozzle sealing means is operable in said clean out mode.

34. A vacuum cleaner operable alternatively as a stand alone vacuum cleaner or as a canister vacuum cleaner with a hose assembly coupled to a canister having a suction fan driven by a motor to collect dirt in a receptacle, comprising:

a nozzle assembly having a beater brush, a suction fan and a motor for driving said beater brush and suction fan;

receptacle means for collecting dirt when said vacuum cleaner is operated as a stand alone vacuum cleaner;

a dirt tube assesmbly having a first air flow passageway coupled to said nozzle assembly and having a second air flow passageway coupled between said first air flow passageway and said receptacle means;

a wand assembly having an air passageway therein coupled to said first air flow passageway; and a handle having an air flow passageway coupled to said wand air flow passageway, said handle being interconnectable with a means for sealing said handle air flow passageway such that dirt is directed from said nozzle assembly by said nozzle suction fan through said first and second air flow passageways to said receptacle means to operate said vacuum cleaner as a stand alone vacuum cleaner and alternatively interconnectable with said hose assembly such that dirt is directed by said canister suction fan from said nozzle assembly through said first air flow passageway, said wand air flow passageway and said handle air flow passageway through said hose assembly to said canister receptacle to operate said vacuum cleaner as a canister vacuum cleaner.

35. A vacuum cleaner as recited in claim 34 wherein said nozzle motor is coupled to a plurality of power lines extending to said handle wherein said sealing means includes a power cord connectable with said power lines to couple power to said nozzle motor.

36. A vacuum cleaner as recited in claim 35 wherein said hose assembly includes a second set of power lines connectable with said nozzle power lines for coupling power to said nozzle motor.

37. A vacuum cleaner as recited in claim 34 wherein said receptacle means includes means for exhausting air therethrough when said vacuum cleaner is operated as a stand alone vacuum cleaner and means for closing said exhaust means to prevent air from passing therethrough when said vacuum cleaner is operated as a canister vacuum cleaner.

38. A vacuum cleaner as recited in claim 37 wherein said receptacle means includes rigid sidewalls.

39. A vacuum cleaner as recited in claim 38 wherein said exhaust means includes a filter disposed in an aperture formed in a sidewall of said receptacle means.

40. A vacuum cleaner as recited in claim 39 wherein said closing means includes a door and means for biasing said door closed.

41. A vacuum cleaner as recited in claim 34 including means operable in a clean out mode for sealing off said nozzle assembly to prevent air flow therefrom to said receptacle means, said receptacle means including an air inlet means having an open state for allowing air external to said vacuum cleaner to enter said receptacle means such that said canister suction fan is operable to direct dirt collected in said receptacle means through said hose assembly to said canister receptacle when said nozzle sealing means is operable in said clean out mode.

42. A vacuum cleaner as recited in claim 41 wherein the state of said air inlet means is changed from a closed state to an open state by suction from said canister suction fan when said nozzle sealing means is operable in said clean out mode.

43. A vacuum cleaner as recited in claim 34 wherein said nozzle suction fan and said canister suction fan operate together to direct dirt to said canister receptacle when said vacuum cleaner is operated as a canister vacuum cleaner.

44. A vacuum cleaner as recited in claim 34 wherein the top of said receptqacle means is open forming an aperture through which dirt may flow and said dirt tube assembly includes a cover with an aperture therein for cooperating with said second air flow passageway, said cover engaging the top of said receptacle means to seal said receptacle means.

45. A vacuum cleaner system for cleaning floor surfaces comprising:

a stand alone vacuum cleaner including a floor-contacting nozzle assembly, dirt receptacle means for collecting dirt, said dirt receptacle means including an air inlet means having an open state to permit air external to said vacuum cleaner to enter said dirt receptacle means when said vacuum cleaner system is operated in a clean out mode, an outlet port and air flow passageway means for alternatively directing dirt from said nozzle assembly to said dirt receptacle means or from said nozzle assembly to said outlet port;

an external container including an inlet port disposed on said external container, suction means for generating suction within said container and a dirt-collecting receptacle for receiving dirt through said inlet port;

means for pneumatically interconnecting said outlet port on said stand alone vacuum cleaner to said inlet port on said external container to direct dirt from said outlet port to said inlet port; and clean out mode means for preventing air flow from said nozzle assembly to said air flow passageway means when said vacuum cleaner system is operated in said clean out mode so that said suction means is operable to cause air to flow into said inlet means and direct dirt collected in said dirt receptacle means to said outlet port through said pneumatically interconnecting means to said inlet port for collection in said dirt-collecting receptacle.

46. The vacuum cleaner system as defined in claim 1 and including a closure means for selectively closing said outlet port when said vacuum cleaner system is to be operated as a stand alone vacuum cleaner.

* * * * *